US008336478B2

(12) United States Patent
Craft

(10) Patent No.: US 8,336,478 B2
(45) Date of Patent: Dec. 25, 2012

(54) SELF-PROPELLED BOAT DOCK SYSTEM

(76) Inventor: Kevin T. Craft, Belton, SC (US)

( * ) Notice: Subject to any disclaimer, the term of this patent is extended or adjusted under 35 U.S.C. 154(b) by 184 days.

(21) Appl. No.: 12/917,239

(22) Filed: Nov. 1, 2010

(65) Prior Publication Data

US 2012/0103242 A1 May 3, 2012

(51) Int. Cl.
*B63B 35/44* (2006.01)

(52) U.S. Cl. ..... 114/263; 405/219

(58) Field of Classification Search ..... 114/230.23, 114/230.26, 230.27, 263; 405/219, 221
See application file for complete search history.

(56) References Cited

U.S. PATENT DOCUMENTS 3,004,391 A * 10/1961 Miller ..... 405/219
3,088,287 A * 5/1963 Berry ..... 405/219
3,683,838 A * 8/1972 Godbersen ..... 114/230.26
5,664,513 A * 9/1997 Echelbarger ..... 114/263
6,295,944 B1 10/2001 Lovett

* cited by examiner

*Primary Examiner* — Lars A Olson
(74) *Attorney, Agent, or Firm* — Turner Padget Graham & Laney, PA

(57) ABSTRACT

A self-propelled boat dock system is provided. In combination with a boat dock and walkway, a system of one or more rollable shore traction elements, winches, and cables is configured to allow a single operator to manipulate the position of the boat dock system from a central controller, the controller being configured to selectively operate the rollable shore traction elements and winches.

11 Claims, 4 Drawing Sheets

SELF-PROPELLED BOAT DOCK SYSTEM

FIELD OF THE INVENTION

The presently disclosed technology relates to a self-propelled apparatus for moving a floating boat dock. More particularly, the presently disclosed technology provides for the manipulation of the position of a floating boat dock relative to the shore with minimal effort.

BACKGROUND OF THE INVENTION

Boat docks are a highly coveted feature for most waterfront properties and often the value of such property can vary substantially based solely on whether a dock permit can be obtained by the property owner. In many cases, permitting regulations prohibit the installation of permanent docks and only allow for the use of floating docks along a shoreline. This type of restriction is found, for example, on lakes that are owned and managed by the United States Army Corps of Engineers.

The U.S. Army Corps of Engineers currently manages more than 450 lakes in the United States. Its goal is to manage and conserve these lakes in a manner consistent with the ecosystem management principles, while providing quality public outdoor recreation experiences to serve the needs of present and future generations. This strategy forces the Corps to balance several factors when managing the inflow and outflow of the lakes. These factors include: navigation, recreation, hydropower, wildlife, habitat, flood control, and the public's water supply. This management strategy can have a profound impact on lake levels, especially when drought conditions arise. In recent years, fluctuations in the lake levels of lakes managed by the Corps of Engineers have become more common and more pronounced.

On such lakes, property owners are prohibited from placing any permanent structure inside the "corps line," which typically encompasses a significant portion of the land leading up to the actual shoreline and is measured in terms of elevation. Therefore, property owners are restricted to the installation of floating docks along the shoreline. This restriction is due in part to the constantly shifting lake levels and the need to utilize a dock structure that can accommodate such conditions. However, these floating docks are extremely heavy, and moving them each time there is a change in the lake levels is both inconvenient and potentially dangerous.

Access to a floating boat dock is typically provided by a walkway. The walkway abuts the shoreline at one end and is affixed to the floating dock at the opposite end. Therefore, it is necessary to maintain the floating dock at a fixed distance from the shoreline so that the walkway is accessible from dry land and the dock is located at a sufficient water depth to keep it afloat. Under Corps regulations, the floating docks must be physically anchored to the shore by the walkway and an approved cabling system. The walkway can be anchored to the shoreline in a number of ways designed to prevent the dock from moving shoreward. One common method is to drive a metal spike into the ground where it is in direct contact with shoreward side of the walkway. Cables are typically attached to anchors that are driven into place on the shoreline above the high water mark, and the cable is then wound onto take-up winches carried by the dock. In this setup, the metal spike prevents the dock and walkway from moving toward the shore, and the cable system prevents the dock from moving away from the shore. Further, the cabling system prevents the dock from moving parallel to the shore and colliding with surrounding docks.

The system as described above functions well in maintaining a floating dock in a constant position along the shoreline. However, when the water level changes the dock must be moved—inward or outward depending on an increased or decreased water level, respectively. Moving a floating dock and walkway is a cumbersome and potentially dangerous event. The sheer weight of the dock alone creates a hazard that can be exacerbated when conditions include high winds and waves. When the water level rises, the dock and attached walkway must be moved shoreward and the cables must be taken until a desired level of tension is reached. When the water level falls, the cables must be paid out and the walkway and dock must be moved to an appropriate water depth. If a dock owner does not make the appropriate adjustments in a timely manner the dock may be damaged in a number of ways. Most notably, if the water level falls the dock may become grounded on the lakebed, which is damaging to the floatation elements and makes the dock significantly harder to move. Further, if the water rises, the cable system may become slack and the dock could swing into other docks or boats anchored nearby.

There is a need for a self-propelled, self-contained, moveable boat-dock system that allows a single owner operator to manipulate the position of a floating dock with minimal effort. It is the object of this invention to provide a means for moving a floating dock relative to a changing lake water level, with which the operator is able to simultaneously control the shoreward position of the walkway the cabling system attached to the dock from a single control center; thereby allowing the operator to move the dock and the attached walkway without exhaustive effort and the risk of injury traditionally required to perform such a task.

SUMMARY OF THE INVENTION

A self-propelled system for moving a floating dock is disclosed. In accordance with certain aspects of certain embodiments of the present subject matter, a combination is provided of a floating dock extending from the shoreline into a body of water that is coupled with at least one rollable shore traction element at the shoreward end, the rollable shore traction element being interposed between the dock and the shore. The rollable shore traction element may be engaged with a driver, the driver configured to propel the rollable shore traction element upon the shore. The combination may further provide a controller in communication with the driver and configured to selectively operate the driver and, in turn, operate the rollable shore traction element. The dock may also be configured to carry a winch, the winch including a cable and being configured to selectively release or retract the cable. Still further, the winch may be engaged with a motor, the motor being in communication with the controller. The controller may be configured to selectively activate the motor, which would in turn selectively operate the winch and release or retract a desired amount of cable contained thereon. The cable may further be adapted for anchoring outboard of the dock and securing the boat dock system in a constant position In accordance with additional aspects of other embodiments of the present subject matter, the boat dock system may include an axle configured with opposed first and second ends. The axle may be carried by the boat dock and coupled with a rollable shore traction element at the first end. Further, the axle may also include a second rollable shore traction element coupled with the second end. The driver may be configured to selectively operate the axle and propel the rollable shore traction elements.

In accordance with aspects of other embodiments of the present subject matter, a combination is provided of a dock and a walkway. The dock is configured for floatation and may be disposed adjacent to a shore. The walkway includes opposed first and second ends, the second end may be coupled with the dock and the first end configured to carry at least one rollable shore traction elements. The walkway may further be configured to carry a driver, the driver engageable with at least one rollable shore traction element and configured to propel the rollable shore traction element. The combination may further provide a controller in communication with the driver and configured to selectively operate the driver. The dock may also be configured to carry a winch, the winch including a cable and being configured to selectively release or retract the cable. Still further, the winch may be engaged with a motor, the motor being in communication with the controller. The controller may be configured to selectively activate the motor, which would in turn selectively operate the winch and release or retract a desired amount of cable contained thereon. The cable may be configured for anchoring outboard of the boat dock and securing the boat dock in a constant position.

In accordance with additional aspects of other embodiments of the present subject matter, the boat dock system may include an axle configured with opposed first and second ends. The axle may be carried by the walkway and coupled with a rollable shore traction element at the first end. Further, the axle may also include a second rollable shore traction element coupled with the second end. The driver may be configured to selectively operate the axle and propel the rollable shore traction elements.

In accordance with additional aspects of other embodiments of the present subject matter, the dock may be configured to carry the controller, the controller being in communication with the motor and the driver and configured to selectively operate both the motor and the driver simultaneously, which in turn may concurrently operate the winch and rollable shore traction elements.

In accordance with additional aspects of other embodiments of the present subject matter, the boat dock system may include a means for driving the walkway upon the shore. The means for driving the walkway may include any combination of components to achieve this function. Such components may include, but not be limited to, wheels, a track and wheel set, caterpillar tracks, a notched rail system, or any other equivalent structure designed to facilitate movement along the shore. Such means may be powered by a right angle gearmotor, a parallel gearmotor, a chain and sprocket drive, a sheave and belt drive, a gear drive, a direct gearmotor drive, a hydraulic drive, any variation of electromechanical motor, or any other equivalent structure designed to transform electrical energy. Such means may be energized by alternating current (AC) or direct current (DC) provided by a fixed or portable source including a battery or solar energy conversion system.

Additional aspects and features of the present subject matter are set forth in the appended drawings and in the detailed description below, or will be apparent to those of ordinary skill in this technology. It should be further appreciated that modifications and variations to specific features and elements may be practiced in various embodiments, and uses of the inventions, without departing from the spirit and scope of the subject matter. Variations might include, but are not limited to, substitution of equivalent means, features, or aspects for those that are illustrated, referenced, or discussed herein, as well as the functional, operational, or positional reverse of various parts, features, aspects, or the like. It is to be understood that different embodiments, as well as presently preferred embodiments of the present subject matter, may include various combinations or configurations of the presently disclosed features, elements, or aspects, or the equivalents. Such embodiments may include combinations of features, parts, or aspects, or configurations thereof that are not expressly shown in the figures or stated in the detailed description. Additional embodiments of the present subject matter, not necessarily expressed in the summarized section, may include or incorporate various combinations of aspects of features, components, or aspects referenced in the summarized subjects above, and/or other features, components, or aspects as otherwise discussed in this disclosure. Those of ordinary skill in the art will better appreciate the features and aspects of such embodiments and others upon review of the remainder of the specification.

BRIEF DESCRIPTION OF THE DRAWINGS

A full and enabling disclosure of the present invention, including the best mode thereof, directed toward one of ordinary skill in the art, is set forth in the specification, which makes reference to the appended figures. It should be noted that the appended drawings are not necessarily to scale in all instances.

DETAILED DESCRIPTION

Figure 1:
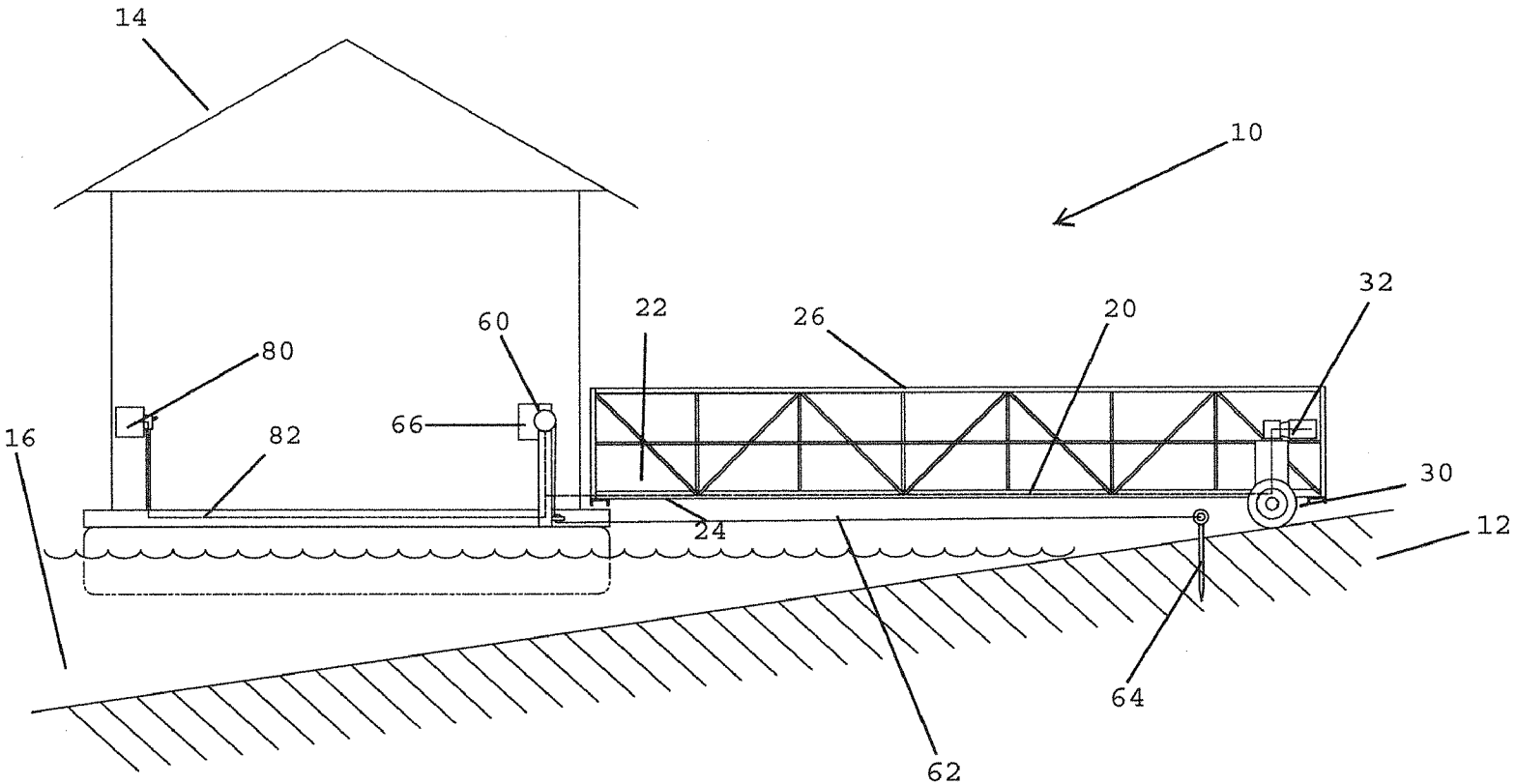
FIG. 1 is a elevation view of one embodiment of the boat dock system, particularly showing the combination of a dock and walkway.

Reference will now be made in detail to presently preferred embodiments of the present subject matter, one or more examples of which are illustrated in the drawings. Each example is provided by way of explanation of the invention, and is not meant as a limitation of the invention. Features illustrated or described as part of one embodiment may be used on another embodiment to yield a further embodiment. It is intended that the present application includes such modifications and variations as come within the scope and spirit of the invention. Selected combinations or aspects of the disclosed subject matter correspond to a plurality of different embodiments of the present invention. Certain features may be interchanged with certain devices or features not expressly mentioned, which perform the same or similar function.

Turning now to the appended figures, according to one aspect of the disclosure, a boat dock system, designated in general by the element number 10, broadly includes a dock 14, a walkway 20, wheels 30, 31, a wheel motor 32, winches 60, 61, winch motors 66, 67, cables 62, 63, and a controller 80.

As shown in FIG. 1, in one embodiment dock 14 is configured to float within a body of water 16 with walkway 20 providing access to dock 14 from the shore 12. Walkway 20 includes a rail 26, an upper side 22 and a lower side 24. At least one wheel 30 is affixed to walkway 20 on lower side 24 and is interposed between shore 12 and walkway 20. Engaged with wheel 30 is wheel motor 32 configured to propel wheel 30 along shore 12 when activated. Winch 60 is incorporated onto dock 14 and is engaged with winch motor 66 that is configured to selectively operate winch 60. Winch 60 includes cable 62 that may be anchored to shore 12 by an anchor 64 in order to secure boat dock system 10 to a fixed position. Controller 80 may be carried by dock 14 and may be in communication with winch motor 66 and wheel motor 32 through incorporated wiring 82. As depicted, controller 80 may operate winch motor 66 and wheel motor 32 simultaneously, thereby allowing an operator to drive the dock 14 relative to the shoreline while winch 60 concurrently releases or retracts the cable 62 in accordance with the movement of dock 14.

Figure 2:
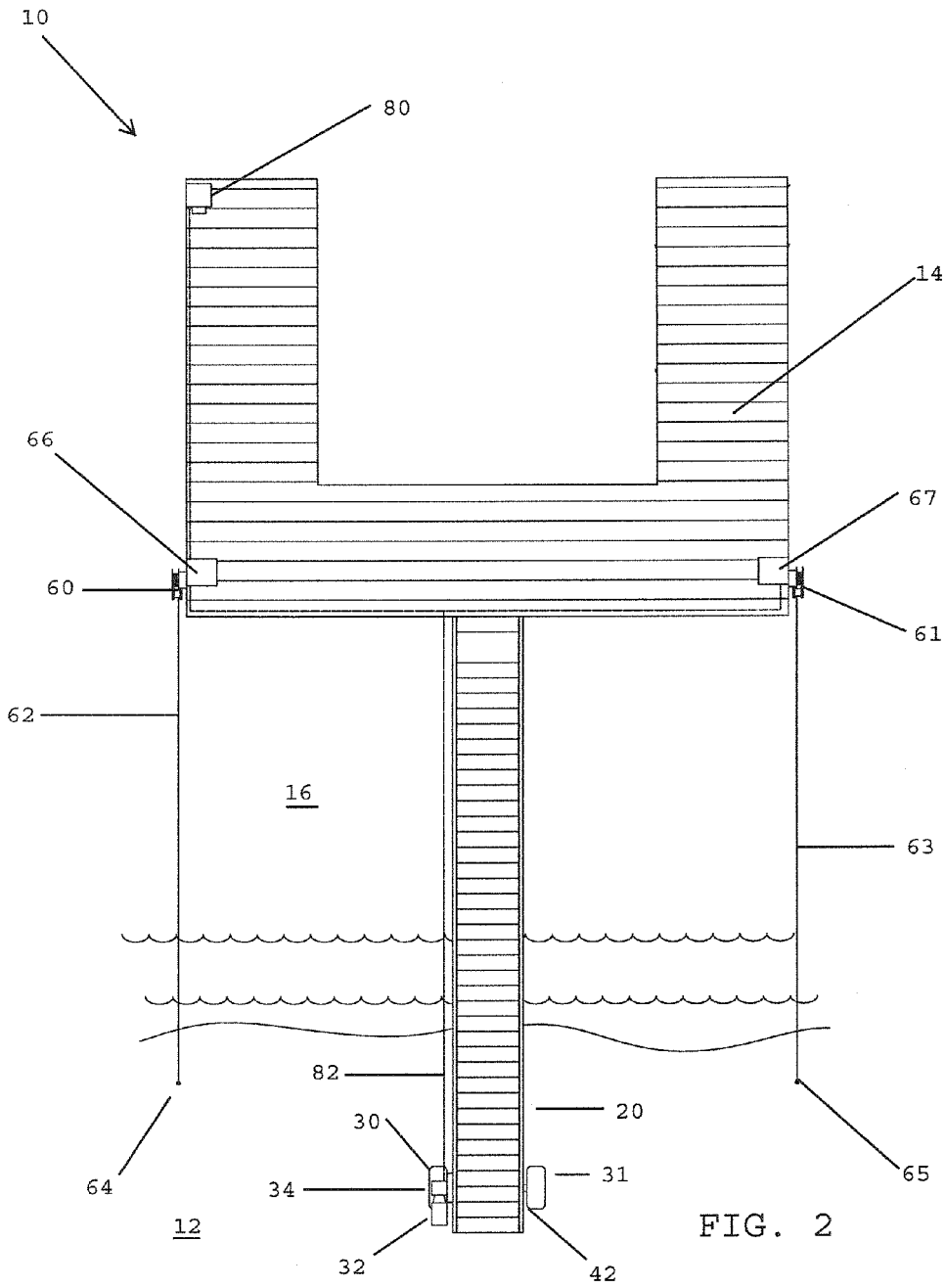
FIG. 2 is an overhead view of one embodiment of the boat dock system, particularly showing the incorporation of two winches, the control center, and two wheels carried by the walkway.

FIG. 2 depicts an embodiment of boat dock system 10 that includes dock 14 and two winches 60, 61, two winch motors 66, 67, two cables 62, 63 attached respectively to anchors 64, 65, and two wheels 30, 31. Wheel motor 32 and reduction box 34 are carried by the walkway and configured to propel wheels 30, 31 by rotation of the axle 42. Controller 80 is carried by dock 14 and is in communication with winch motors 66, 67 and wheel motor 32 through wiring 82. When controller 80 is activated, wheels 30, 31 can be operated to drive dock system 10 along shore 12 while winches 60, 61 concurrently release or retract a desired amount of cables 62, 63.

Figure 3:
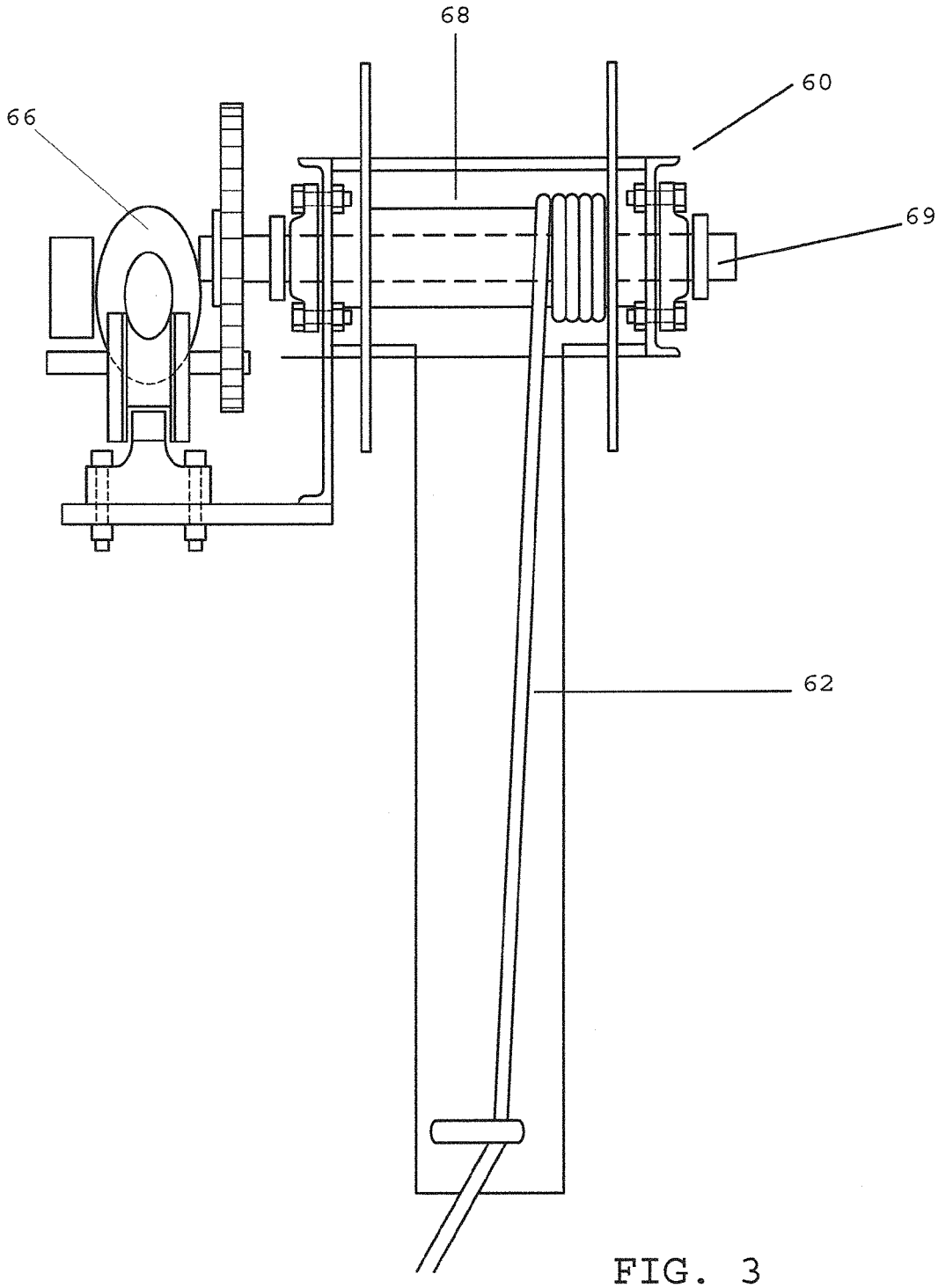
FIG. 3 is a elevation view of the winch, motor, and cable aspect of one embodiment of the boat dock system.

FIG. 3 depicts winch 60 including a spool 68 and winch axle 69. In this embodiment, motor 66 is a right angle gearmotor used to mechanically drive winch 60 to selectively release and retract cable 62. Motor 60 may be right angle or parallel gearmotor capable of using AC or DC power with a direct drive, a chain drive, a belt drive, a gear drive, or any other equivalent structure that may be used to drive winch 60.

Figure 4:
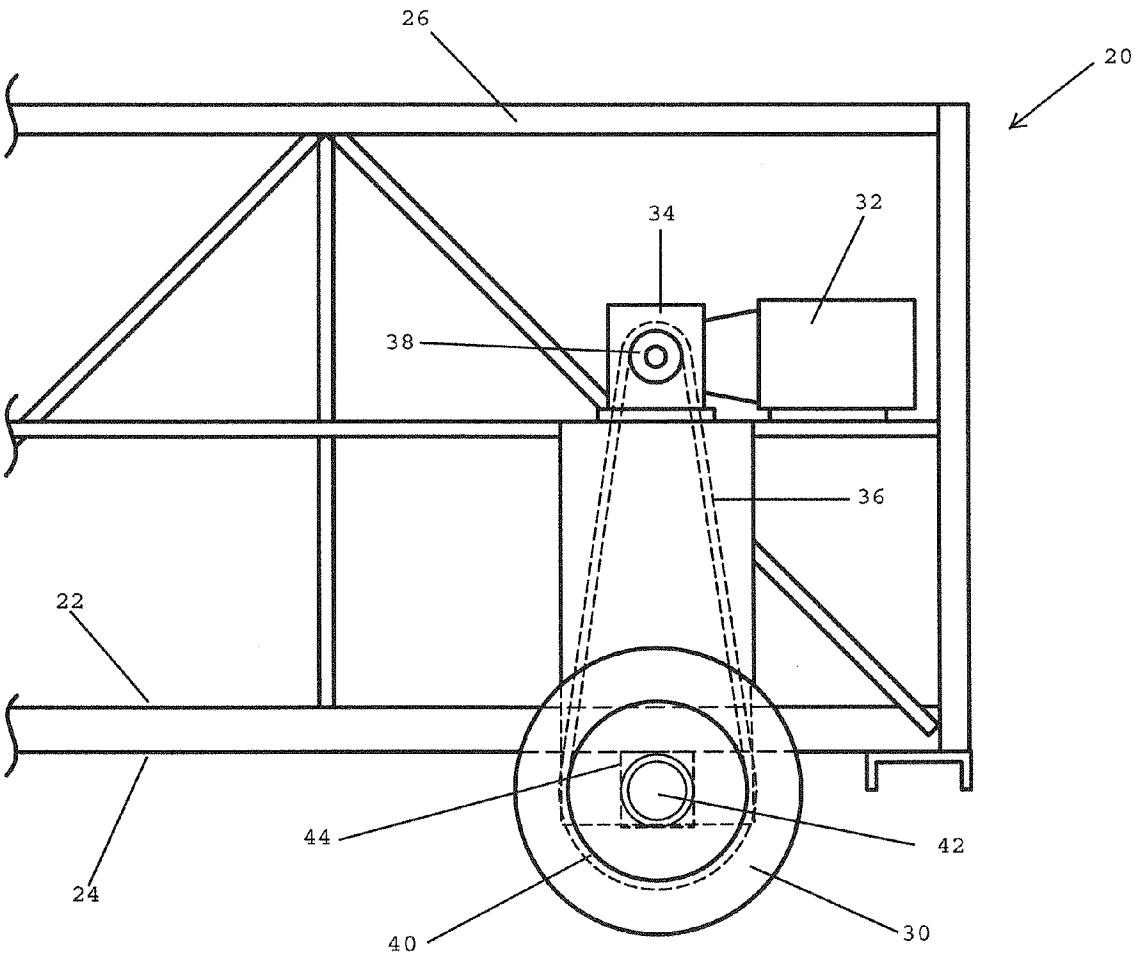
FIG. 4 is a elevation view of the wheels, driver, and axle incorporated onto the walkway in one embodiment of the boat dock system.

FIG. 4 is an elevation view of one embodiment depicting the utilization of a wheel-based system to drive boat dock system 10 along the shore. Axle 42 may be carried by walkway 20 on lower side 24 and coupled to the wheels 30, 31. In the depicted embodiment, the system further includes wheel motor 32 and reduction box 34, and further incorporates a chain 36 affixed to the drive gear 38 and sprocket 40 used to rotate the axle and propel the wheels along the shore. The wheel motor depicted is a right angle gearmotor drive; however, one of ordinary skill in the art would recognize that a parallel gearmotor drive or any other equivalent structure could be substituted. Further, the embodiment depicts a chain and sprocket drive; alternative embodiments may include a sheave and belt drive, a gear drive, a direct gearmotor drive, or other mechanisms that would drive the rotation of the wheels 30, 31 along shore 12.

As disclosed herein, the present invention provides a self-propelled system for moving a floating dock relative to the shoreline. While preferred embodiments of the invention have been shown and described, modifications and variations may be made thereto by those skilled in the art without departing from the spirit and scope of the present invention. For instance, the boat dock system may be powered by an AC current or a portable DC current source such as a battery or solar power energy system. Thus, it should be understood that aspects of various embodiments may be interchanged, both in whole or in part. Furthermore, those of ordinary skill in the art will appreciate that the foregoing description is by way of example only, and is not intended to be a limitation of the invention as further described in the appended claims.

The invention claimed is:

1. A boat dock system abutting a shore, comprising:

a dock;

first and second rollable shore traction elements, said first and second rollable shore traction elements carried by said dock and disposed upon said shore;

an axle, said axle including opposed first and second ends, said first rollable shore traction element disposed upon said first end and said second rollable shore traction element disposed upon said second end;

a driver, said driver carried by said dock, said driver engageable with and configured to roll at least one of said first and second rollable shore traction, elements;

a controller, said controller in communication with said driver and configured to selectively energize said driver;

whereby said dock system may be self-propelled relative to said shore by selectively energizing said driver with said controller to roll said at least one rollable shore traction element upon said shore.

2. The boat dock system as in claim 1, wherein said axle is carried by said boat dock, said driver is engageable to said axle and configured to rotate said axle and to roll said first and second rollable shore traction elements.

3. The boat dock system as in claim 2, further comprising:

a winch, said winch including a cable, said winch configured to selectively release or retract said cable; and a motor, said motor engageable to said winch and in communication with said controller, said controller configured to selectively activate said motor, and said motor configured to selectively operate said winch.

4. The boat dock system as in claim 3, wherein said winch is carried by said boat dock and said cable includes a first end adapted for anchoring outboard of said boat dock.

5. A boat dock system abutting a shore, comprising:

a boat dock configured for floatation upon water and disposed adjacent to said shore;

a walkway, said walkway including opposed first and second ends, said second end coupled with said boat dock;

at least one rollable shore traction element, said at least one rollable shore traction element carried by said walkway at said first end and disposed upon said shore;

a driver, said driver carried by said walkway and engageable with said at least one rollable shore traction element, said driver configured to propel said at least one rollable shore traction element;

a winch, said winch including a cable, said winch configured to selectively release or retract said cable;

a motor, said motor engageable to said winch and configured to selectively operate said winch;

a controller, said controller in communication with said driver and said motor, said controller configured to selectively activate said motor and said driver whereby said boat dock system may be propelled relative to said shore.

6. The boat dock system as in claim 5, further comprising a second rollable shore traction element, said second rollable shore traction element coupled to said first rollable shore traction element.

7. The boat dock system as in claim 6, further comprising an axle, said axle including opposed first and second ends, said first rollable shore traction element coupled to said first end and said second rollable shore traction element coupled to said second end.

8. The boat dock system as in claim 7, wherein said axle is carried by said boat dock, said driver is engageable to said axle and configured to rotate said axle and propel said first and second rollable shore traction elements.

9. The boat dock system as in claim 5, wherein said controller is carried by said boat dock.

10. The boat dock system as in claim 5, wherein said winch is carried by said boat dock system.

11. A boat dock system abutting a shore, comprising:

a boat dock configured for floatation upon water and disposed adjacent to said shore;

a walkway, said walkway including opposed first and second ends, said second end coupled with said boat dock;

driving means for driving said walkway upon said shore;

a winch, said winch carried by said boat dock and including a cable, said winch configured to selectively release or retract said cable, said cable adapted for anchoring said boat dock system;

a motor, said motor engageable to said winch and configured to selectively operate said winch;

a controller, said controller carried upon said boat dock system and in communication with said driver and said motor, said controller configured to selectively activate said motor and said driver whereby said boat dock system may be propelled relative to said shore.

* * * * *